United States Patent [19]

Foster et al.

[11] 4,192,047

[45] Mar. 11, 1980

[54] METHOD OF TREATING MULTIFILAMENT SYNTHETIC YARN

[75] Inventors: Peter W. Foster; Thomas Berry, both of Tiverton, England; Karel Murenbeeld, Geneva, Switzerland

[73] Assignee: John Heathcoat & Company Limited, Tiverton, England

[21] Appl. No.: 871,334

[22] Filed: Jan. 23, 1978

[30] Foreign Application Priority Data

Jan. 27, 1977 [GB] United Kingdom ..... 3298/77

[51] Int. Cl.[2] ..... D02G 1/16; D02J 1/22

[52] U.S. Cl. ..... 28/220; 28/246; 28/258; 264/289.3; 28/271

[58] Field of Search ..... 28/220, 246, 258, 271; 264/290 T

[56] References Cited

U.S. PATENT DOCUMENTS

| | | | |
|---|---|---|---|
| 2,953,428 | 9/1960 | Hunt et al. | 28/220 X |
| 3,364,294 | 1/1968 | Garibian et al. | 28/220 X |
| 3,423,809 | 1/1969 | Schmitt | 28/220 X |
| 3,703,753 | 11/1972 | Binford et al. | 28/220 |
| 3,975,484 | 8/1976 | Okada et al. | 28/220 X |

*Primary Examiner*—Louis Rimrodt

*Attorney, Agent, or Firm*—Larson, Taylor and Hinds

[57] ABSTRACT

A method of producing commercially usable textured synthetic multifilament yarn from commercially produced undrawn multifilament synthetic yarn of a type which has normally a limited operational life and which has exceeded the normal operational life for undrawn yarn in which the overage undrawn yarn is fed continuously without pause through two discrete successive treatments with hot fluid at a temperature high enough to plasticize the yarn. The yarn is drawn to a chosen ratio of extension while it is passing through the first treatment with hot fluid. Next the yarn is jet textured while it is passing through the second treatment with hot fluid. The yarn may be subjected to a cooling action between the two successive treatments with hot fluid.

1 Claim, 1 Drawing Figure

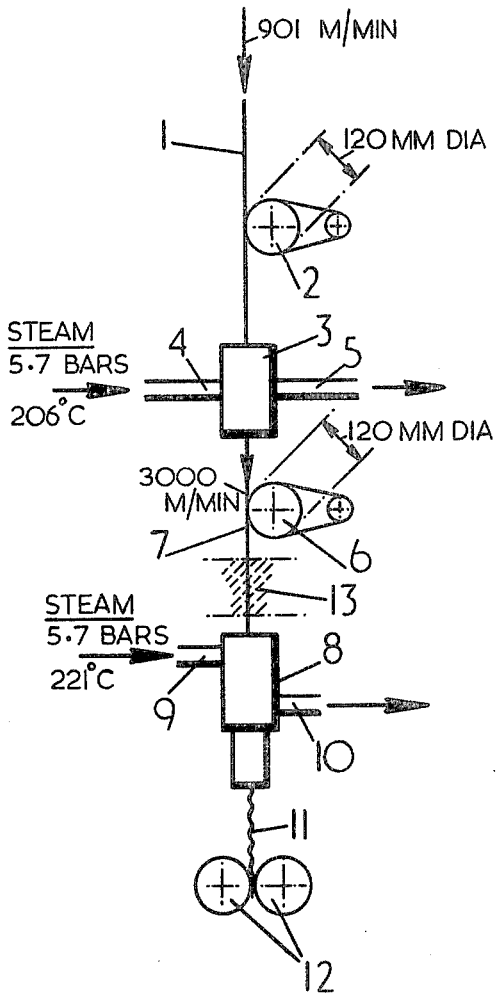
901 M/MIN
1
120 MM DIA
2
STEAM
5·7 BARS
206°C
4
3
5
120 MM DIA
3000
M/MIN
7
6
13
STEAM
5·7 BARS
221°C
9
8
10
11
12

METHOD OF TREATING MULTIFILAMENT SYNTHETIC YARN

This invention relates to the production of textured or bulked multifilament synthetic yarn, i.e. multifilament yarn in which the filaments are heated to plasticize them and then separated from one another and are usually crimped as well.

The first step in the production of multifilament yarn is to produce monofilaments from a spinneret and form these monofilaments into a yarn which is customarily referred to as undrawn yarn. In this condition the chains of molecules of the polymeric material forming the filaments are orientated at random in the filaments and have a strength so low that few commercial uses can be found for the yarn. To increase the strength of the filaments to a degree sufficient to make the yarn capable of being textured the yarn is drawn by an amount which is a multiple of its original length. This causes the chains of molecules of the filament material all to become orientated in substantially the same direction so that the strength of the filaments and thus of the yarn is considerably increased.

It has long been widely believed in the synthetic yarn industry that certain undrawn yarns such as polyester made from filaments straight from the spinneret have a very short "operational" life during which the yarn must be drawn otherwise it acquires characteristics which remain through all subsequent operations to which the yarn may be subjected and which manifest themselves as an unacceptably high proportion of breakages in the filaments of the yarn. Such operational life varies somewhat but for polyester for example is seldom more than 14 days while often being as short as six days. Even this minimum life can be achieved only if the yarn is stored in controlled conditions of temperature and humidity. Without such careful storage the operational life of such undrawn yarn is even less than this. The result of this short life is that careful planning and control are necessary for the production of satisfactory drawn yarn so that yarn coming from the spinneret is always used within a few days of the spinning of the yarn. Because of transport and handling times it is very difficult to maintain such a schedule and frequently large quantities of yarn are found to be unusable when for any reason, for example a delay in transit, it has not been found possible to process it within its operational life.

The applicants have found a method of producing commercially usable drawn and textured yarn from commercially produced undrawn yarn of a type which has aged beyond the normal operational life of such yarn.

The applicants' method thus makes it unnecessary to co-ordinate closely the production and treatment of these yarns as the undrawn yarn can now be stored under normal workshop conditions for an indefinite period far beyond the normal operation life of the yarn and can then still be textured satisfactorily.

According to the invention a method of producing commercially usable textured synthetic multifilament yarn from commercially produced undrawn multifilament synthetic yarn of a type which has normally a limited operational life and which has exceeded the normal operational life for undrawn yarn includes the steps of feeding the overage undrawn yarn continuously without pause through two discrete successive treatments with hot fluid at a temperature at which the yarn material becomes plasticized, drawing it while hot to a chosen ratio of extension in the first treatment and jet texturing the yarn in the second treatment.

The yarn may be subjected to a cooling action between the two treatments with hot fluid.

The hot fluid may be a liquid or a gaseous fluid.

The drawing temperature is that normally pertaining to the particular yarn being treated and is readily ascertainable.

The chosen ratio of extension in drawing for the overage yarn being treated may be the same ratio of extension as that to which newly spun yarn of the same type would normally be subjected. The normal ratio of extension for drawing any particular yarn is readily ascertainable.

The expression "jet texturing" means here a bulking and/or crimping process of the known type in which the filaments constituting the yarn are plasticized, separated and crimped in a jet of hot fluid.

The invention provides the heretofore totally unexpected and very valuable effect that the interaction of the drawing process under hot fluid conditions and the subsequent texturing process using the jet technique provides that the yarn previously unusable for most purposes becomes bulked and/or crimped yarn of acceptable commercial quality.

Although experiments have not been completed it has been found that the process of the invention makes it possible to provide a bulked yarn of commercially acceptable quality from undrawn yarn stored in completely uncontrolled conditions for at least four years.

The accompanying drawing is a diagram of the process of the invention. In the diagram 1 denotes undrawn yarn of an age at which it is too brittle for most commercial purposes, 2 denotes a set of drawing rollers arranged to feed the yarn 1 forwardly at a given speed, 3 denotes a heating device in which the yarn is brought into contact with steam entering through the conduit 4 and exhausting through the exhaust conduit 5, and 6 denotes a second set of feed rollers operating at a higher peripheral speed than the rollers 2 so that the yarn is drawn between the two sets of rollers 2 and 6. The yarn 7 leaving the set of rollers 6 is drawn yarn. 8 denotes a jet texturing device using steam entering through the conduit 9 and exhausting through the conduit 10. In the device 8 the yarn 7 is textured and issues as textured yarn 11 with its qualities enhanced sufficiently to make it usable for all usual commercial purposes. The yarn 11 is led away by the take off rollers 12. 13 denotes an optional cooling zone.

EXAMPLE

Fully undrawn polyester feedstock manufactured by Société Viscose Suisse S.A. in Switzerland which had been stored in an unconditioned warehouse for approximately four years was used for this experiment. The total initial D'tex of the undrawn feed yarn was 556 d'tex made up of 30 filaments. The supply merge (i.e. batch number) of the yarn was Merge 1683 of Type 211 Tersuisse.

The yarn was drawn, cooled and textured in apparatus as illustrated in the drawing and under the conditions specified below. In the drawing stage yarn was drawn off the feed package at a speed of 901 m/min by means of a feed roll (2) with a diameter of 120 mm. It was fed into a heating device (3) in which it was heated by steam at a pressure of 5.7 bars and a steam temperature of 206° C. The draw roll (6) pulling the yarn through the heating device (3) had a diameter of 120 mm and rotated at a peripheral speed of 3000 m/min thus providing a draw ratio of 3.33. The yarn was fed to the jet texturing device (8) which operated at a steam pressure of 5.7 bars and a steam temperature of 221° C. and was withdrawn by take-off rollers (12) as textured yarn at a speed such that the ratio of feed speed to withdrawal speed provided an overfeed of 22%. The yarn leaving the jet texturing device was actually superior to yarn of the same type which has been drawn immediately after leaving the spinneret and had been subsequently textured.

The reason for the success of the invention is not yet properly understood but it is known that certain yarn materials after they leave the spinneret start to become more and more crystalline and brittle. The time taken to become too brittle for most commercial uses can be as little as six days. It seems likely that in the process of the invention the first heating using a hot fluid followed by jet texturing also using a hot fluid with or without cooling, deliberate or unintentional between the two heating actions, or a small change of temperature, causes a reversal of the crystallizing action.

What is claimed is:

1. A method of forming commercially usable textured synthetic multifilament yarn from commercially produced undrawn multifilament synthetic yarn of a type which when undrawn has normally a limited operational life and which has exceeded that normal operational life comprising the steps, performed successively without pause and as a continuous operation, of plasticizing the yarn by treatment with hot fluid and drawing the yarn to a chosen ratio of extension while it is plasticized, cooling said plasticized and drawn yarn, then plasticizing the yarn a second time and jet texturing the yarn while it is plasticized for the second time.

* * * * *